US008241079B2

(12) United States Patent
Martino

(10) Patent No.: US 8,241,079 B2
(45) Date of Patent: Aug. 14, 2012

(54) PUMP JET ASSEMBLY AND RELATED ADAPTER SYSTEM AND METHOD

(75) Inventor: John David Martino, Longwood, FL (US)

(73) Assignee: Applied Combustion Technology, Inc., Orlando, FL (US)

( * ) Notice: Subject to any disclaimer, the term of this patent is extended or adjusted under 35 U.S.C. 154(b) by 224 days.

(21) Appl. No.: 12/548,884

(22) Filed: Aug. 27, 2009

(65) Prior Publication Data

US 2011/0053439 A1 Mar. 3, 2011

(51) Int. Cl.
*B63H 11/00* (2006.01)

(52) U.S. Cl. ..... 440/38

(58) Field of Classification Search ..... 440/38; 415/208.2; 29/888.025
See application file for complete search history.

(56) References Cited

U.S. PATENT DOCUMENTS 3,849,982 A * 11/1974 Hall ..... 60/221
5,366,396 A * 11/1994 Schulze ..... 440/38
6,139,379 A * 10/2000 Jamieson ..... 440/38

* cited by examiner

*Primary Examiner* — Daniel Venne
(74) *Attorney, Agent, or Firm* — Allen, Dyer, Doppelt, Milbrath & Gilchrist, P.A.

(57) ABSTRACT

A pump jet assembly includes universal components, such as a rotor, shroud and stator, that can accommodate all marine drives within a given range and adapter components, that accommodate the difference between the universal components and a particular marine drive within the range. A pump jet adapter system includes both the universal components and a plurality of adapter components, and is made by assessing a variation in parameters for the range of marine drives and determining rotor parameters to allow use of a universal rotor for all the range of marine drives. Parameters for adapter components are determined to correspond to different marine drives within the range.

5 Claims, 5 Drawing Sheets

PUMP JET ASSEMBLY AND RELATED ADAPTER SYSTEM AND METHOD

FIELD OF THE INVENTION

The present invention relates to pump jet assemblies, and more particularly, to the retrofitting of propeller-driven marine drives with pump jet assemblies.

BACKGROUND OF THE INVENTION

Pump jets are known to offer several advantages over propellers in use with marine drives. For instance, the shrouded construction of pump jets significantly reduces the risk of injury to marine life and divers, relative to propellers. Additionally, pump jets generate a more concentrated, directional thrust. Because of these and other advantages, it is known to retrofit propeller-driven marine drives with pump jets.

Referring to FIG. 1, a typical marine drive 110, such as an outboard motor, includes an engine 112, a drive shaft 114, a gear housing 116, a propeller shaft 118 and a propeller 120. The engine 112 turns the drive shaft 114. Through gear housing 116, the rotational motion of the drive shaft 114 is transferred to the propeller shaft 118 and the propeller 120.

Referring to FIG. 2, the propeller shaft 118 and propeller 120 rotate about a shaft axis 124. The propeller shaft 118 extends through a propeller shaft passage 126 defined within the propeller 120. A thrust bushing 28 is arranged between the propeller 120 and an axial end face 130 of the gear housing 116. A retention nut 132 holds the propeller 120 onto the propeller shaft 118. As will be appreciated, the propeller 120 can be removed by removing the retention nut 132 and sliding the propeller 120 off the shaft 118.

Referring to FIG. 3, with the propeller 120 removed, a pump jet assembly 140 can be retrofit to the marine drive. The pump jet assembly 140 includes a shroud 142 and a rotor 144. The shroud 142 surrounds the rotor 144, directing water flow thereto and channeling water flow therefrom.

The shroud 142 can be divided into a front shroud portion 146 and a rear shroud portion 148, which are detachably connected. The front shroud portion 146 includes a plurality of forward stationary vanes 150, extending radially between the front shroud portion 146 and the gear housing 116. The rear shroud portion 148 includes a plurality of rear stationary vanes 158 extending radially between the rear shroud portion 148 and a stator hub 160. The rear stationary vanes 158 and the stator hub 160 are collectively referred to as the stator and direct water flow passing through the rear axial end 162 of the shroud 142.

The rotor 144 includes a central hub 164 with a plurality of rotor blades 166 extending radially outward therefrom. The rotor 144 is mounted substantially coaxially with the propeller shaft 118. The nut 132 holds the rotor 144 onto the shaft 118.

An exhaust block/duct adapter 184 is arranged above the gear housing 116. The exhaust block/duct adapter 184 blocks the normal outboard motor exhaust path which routes exhaust gas out the gear housing 116, where it would be dispersed by the propeller 116. Instead, the adapter 184 allows the exhaust gases to be channeled to an exhaust duct 186, preventing cavitation of the pump jet assembly 140 due to exhaust gases passing through the shroud 142.

SUMMARY OF THE INVENTION

Based on the foregoing, it is an object of the present invention to provide an improved pump jet assembly. In particular, it is an object of the present invention to provide a pump jet assembly that utilizes one or more universal components that can accommodate a range of marine drives, as well as adapter components that compensate for differences between the universal components and the marine drives within the range.

According to an embodiment of the present invention, a pump jet assembly for a marine drive includes a shroud, a stator fixedly arranged within the shroud, and a rotor rotatably arranged within the shroud. The rotor has a sleeve passage defined therein extending from a forward to a rear axial end of the rotor. A rotor adapter sleeve is accommodated within the sleeve passage and has a shaft passage defined therein for accommodating a propeller shaft of the marine drive. An axial rotor adapter is concentric with the shaft passage and engages the forward axial end of the rotor.

According to another embodiment of the present invention, a rotor adapter system for a range of marine drives includes a shroud having a stator therein, a rotor accommodatable within the shroud and having a rotor sleeve passage radially dimensioned to accommodate all propeller shaft diameters for the range of marine drives, and a plurality of rotor adapter sleeves, each of the rotor adapter sleeves dimensioned to accommodate a difference between the rotor sleeve passage dimensions and a different one of the propeller shaft diameters within the range of marine drives.

According to a method aspect, a method of making a pump jet adapter system for a range of marine drives includes assessing a variation in parameters for the range of marine drives and determining rotor parameters to allow use of a universal rotor for all the range of marine drives. Parameters for adapter components are determined to correspond to different marine drives within the range. The universal rotor and the plurality of adapter components are then made with the determined parameters.

These and other objects, aspects and advantages of the present invention will be better understood in view of the drawings and following detailed description of preferred embodiments.

DETAILED DESCRIPTION OF PREFERRED EMBODIMENTS

Figure 4:
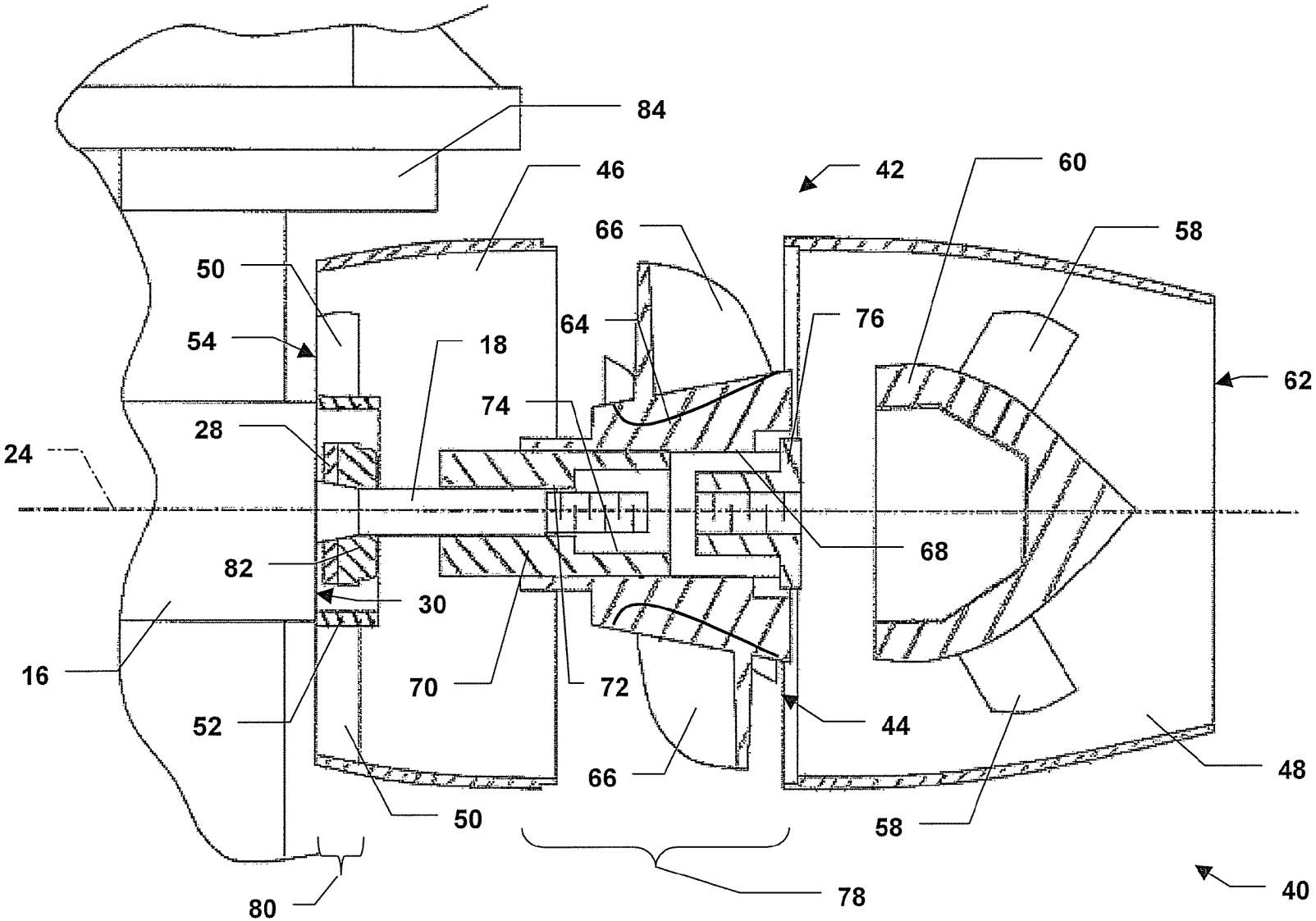
FIG. 4 is a partially exploded side view of a portion of a marine drive retrofitted with a pump jet assembly, according to an embodiment of the present invention.

Referring to FIG. 4, a gear housing 16 has a propeller shaft 18, rotatable about a propeller shaft axis 24, extending from a gear housing rear axial end face 30. For referential purposes, the "axial" refers the direction in which the propeller shaft axis extends and "radial" refers to any direction perpendicular to the axial direction. With reference to the orientation shown in FIG. 4, "forward" and "front" refer to elements relatively further to the left in the axial direction and "rearward" and "rear" refer to elements relatively further to the right in the axial direction.

According to an embodiment of the present invention, a retrofitted pump jet assembly 40 includes a shroud 42 and a rotor 44. The shroud 42 surrounds the rotor 44, directing water flow thereto and channeling water flow therefrom. It will be appreciated that the pump jet assembly 40 is operable to propel an associated marine craft in either forward or rearward directions.

The shroud 42 is preferably divided into a front shroud portion 46 and a rear shroud portion 48, which are detachably connected using, for example, a plurality of machine screws. Advantageously, the rear shroud portion 48 can be readily removed to allow enhanced access to the rotor 44, propeller shaft 18 and gear housing 16 for inspection and maintenance.

The front shroud portion 46 includes a plurality of forward stationary vanes 50, extending radially between the front shroud portion 46 and a housing adapter 52. The forward stationary vanes 50 direct water passing through the forward axial end 54 of the shroud 42. The housing adapter 52 ensures that there will be a smooth transition for water flowing off the gear housing 16 and onto the rotor 44, such that it is not necessary to radially or axially dimension the axial front end of the rotor 44 to achieve the smooth flow transition.

The rear shroud portion 48 includes a plurality of rear stationary vanes 58 extending radially between the rear shroud portion 48 and a stator hub 60. The rear stationary vanes 58 and the stator hub 60 are collectively referred to as the stator and direct water flow passing through the rear axial end 62 of the shroud 42.

The rotor 44 includes a central hub 64 with a plurality of rotor blades 66 extending radially outward therefrom. The blades 66 are connected to the hub 64 and have a fixed pitch relative thereto. As will be described below, the fixed pitch of the blades 66 can advantageously be selected when securing the blades 66 to the hub 64. The rotor 44 is mounted substantially coaxially with the propeller shaft 18 and defines a sleeve passage 68 extending axially therethrough. The sleeve passage 68 is, in the radial direction, dimensioned larger than the propeller shaft 18.

A rotor adapter sleeve 70 is closely accommodated within the sleeve passage 68 of the rotor 44. The rotor adapter sleeve 70 defines a shaft passage 72 extending axially therethrough, a portion of which is radially dimensioned to closely accommodate the propeller shaft 18. As a result, the rotor adapter sleeve 70 effectively makes up the difference between the radial dimensions of the propeller shaft 18 and the sleeve passage 68 of the rotor 44.

The shaft passage 72 has an expanded portion 74, having a larger radial dimension the propeller shaft. The expanded portion 74 allows a rotor securing adapter 76 to be threaded within the rotor adapter sleeve 70 around a threaded rear portion of the propeller shaft 18. The rotor securing adapter 76 engages both the propeller shaft 18 and the rotor 44 to prevent the rotor 44 from moving rearward off the propeller shaft 18.

The overall axial length 78 of the rotor 44 is sufficiently short such that a desired axial standoff distance 80 is not set with original thrust bushing 28. An axial rotor adapter 82 sets the desired axial standoff distance 80 between an axial forward end of the rotor 44 and the axial end face 30 of the gear housing 16. For illustrative and comparative purposes, the axial rotor adapter 82 is shown extending axially rearwards of the original thrust bushing 28. However, the axial rotor adapter 82 is preferably dimensioned longer axially, such that the axial rotor adapter 82 would completely replace the original thrust bushing 28 and still set the desired axial standoff distance 80.

Figure 1:
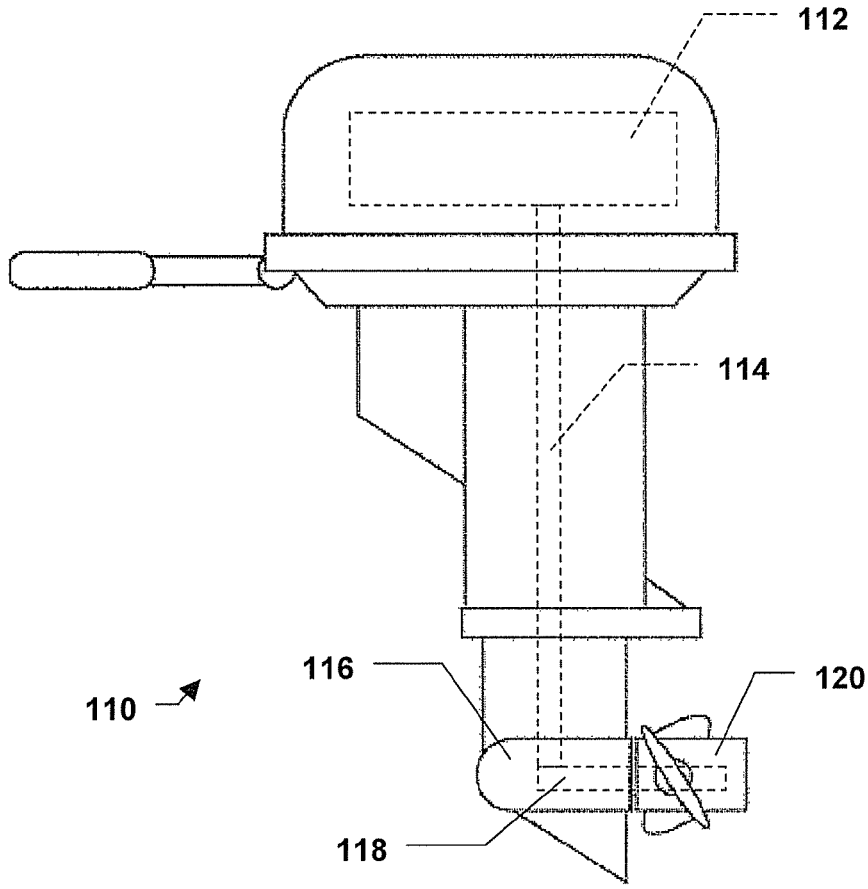
FIG. 1 (prior art)
FIG. 1 is a side view of a marine drive.
Figure 2:
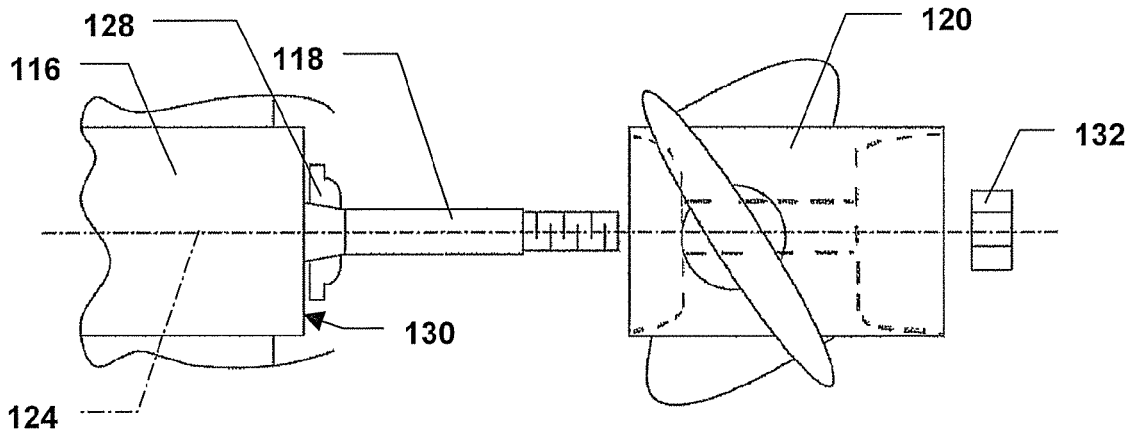
FIG. 2 (prior art)
FIG. 2 is a partially exploded detail view of a portion of the marine drive of FIG. 1.
Figure 3:
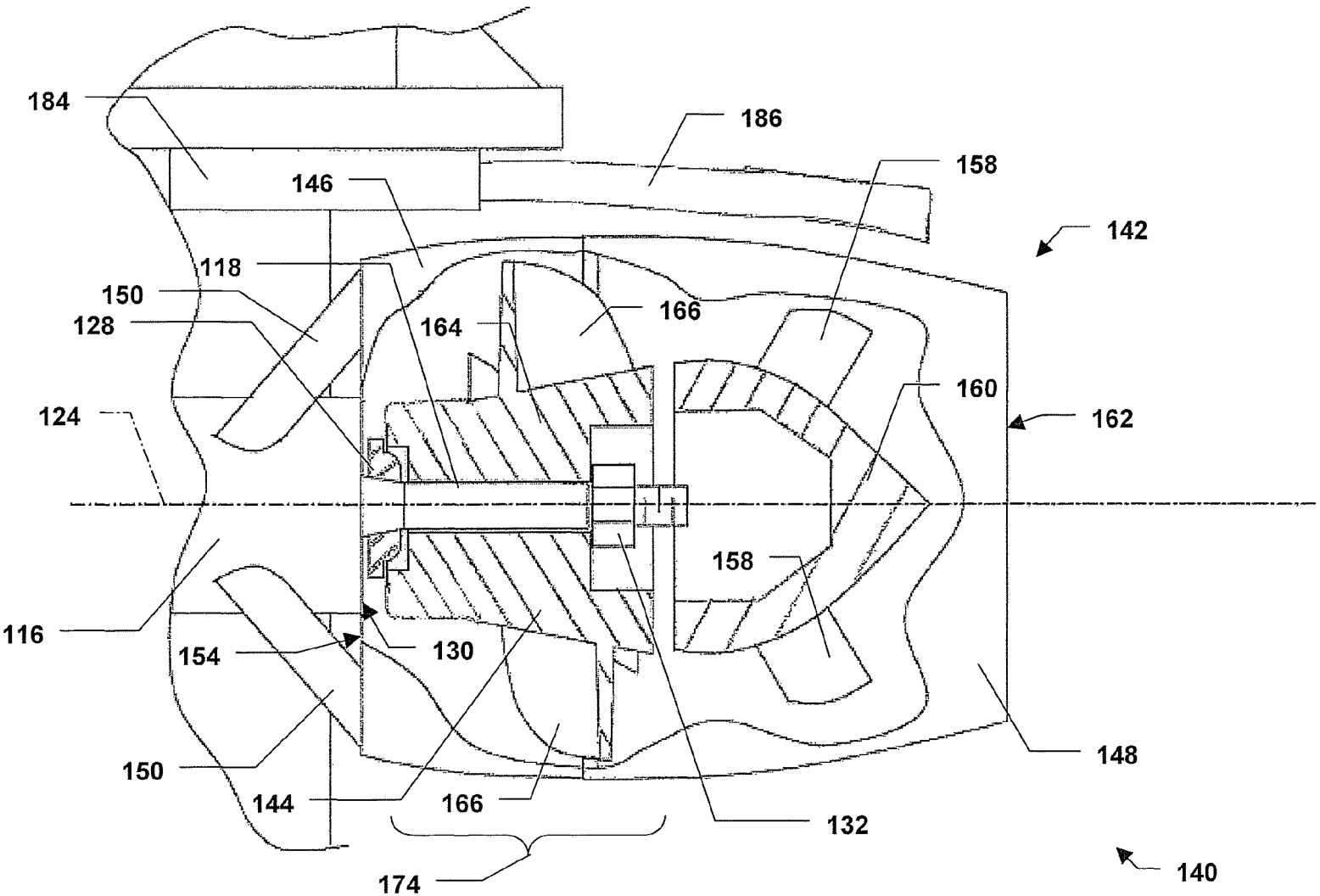
FIG. 3 (prior art)
FIG. 3 is a side detail view of the portion of the marine drive of FIG. 1, retrofitted with a pump jet assembly.

An exhaust block/duct adapter 84 is arranged above the gear housing 16. The exhaust block/duct adapter 84 blocks the typical outboard motor exhaust path which routes exhaust gas out the gear housing 16, where it would be dispersed by the propeller. Instead, the adapter 84 allows the exhaust gases to be channeled to an exhaust duct (see, e.g., exhaust duct 186 in FIG. 3), preventing cavitation of the pump jet assembly 40 due to exhaust gases passing through the shroud 42.

Figure 5:
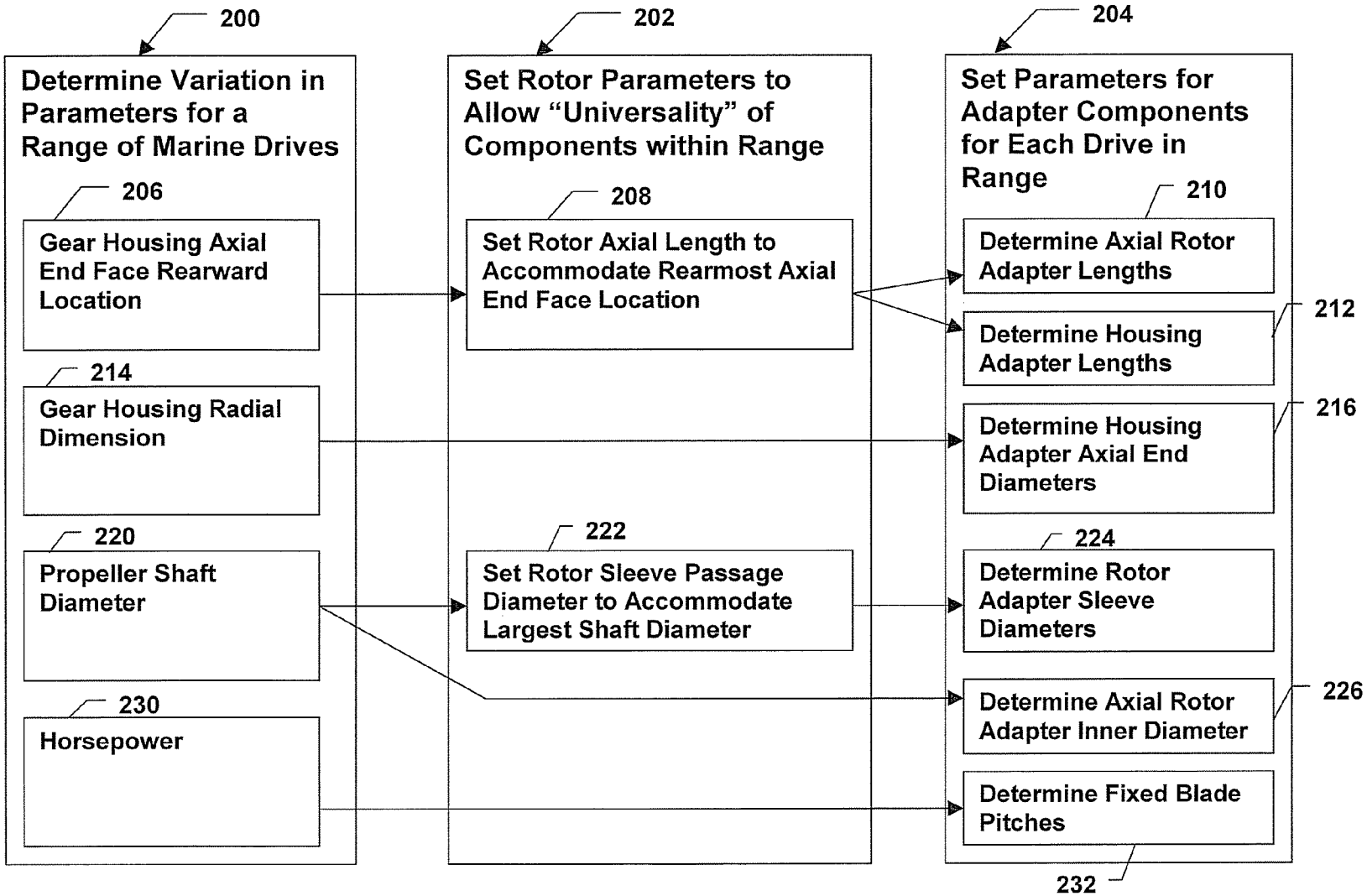
FIG. 5 is a flow diagram of a method of making a pump jet adapter system for a range of marine drives, according to a method aspect of the present invention.
Figure 6:
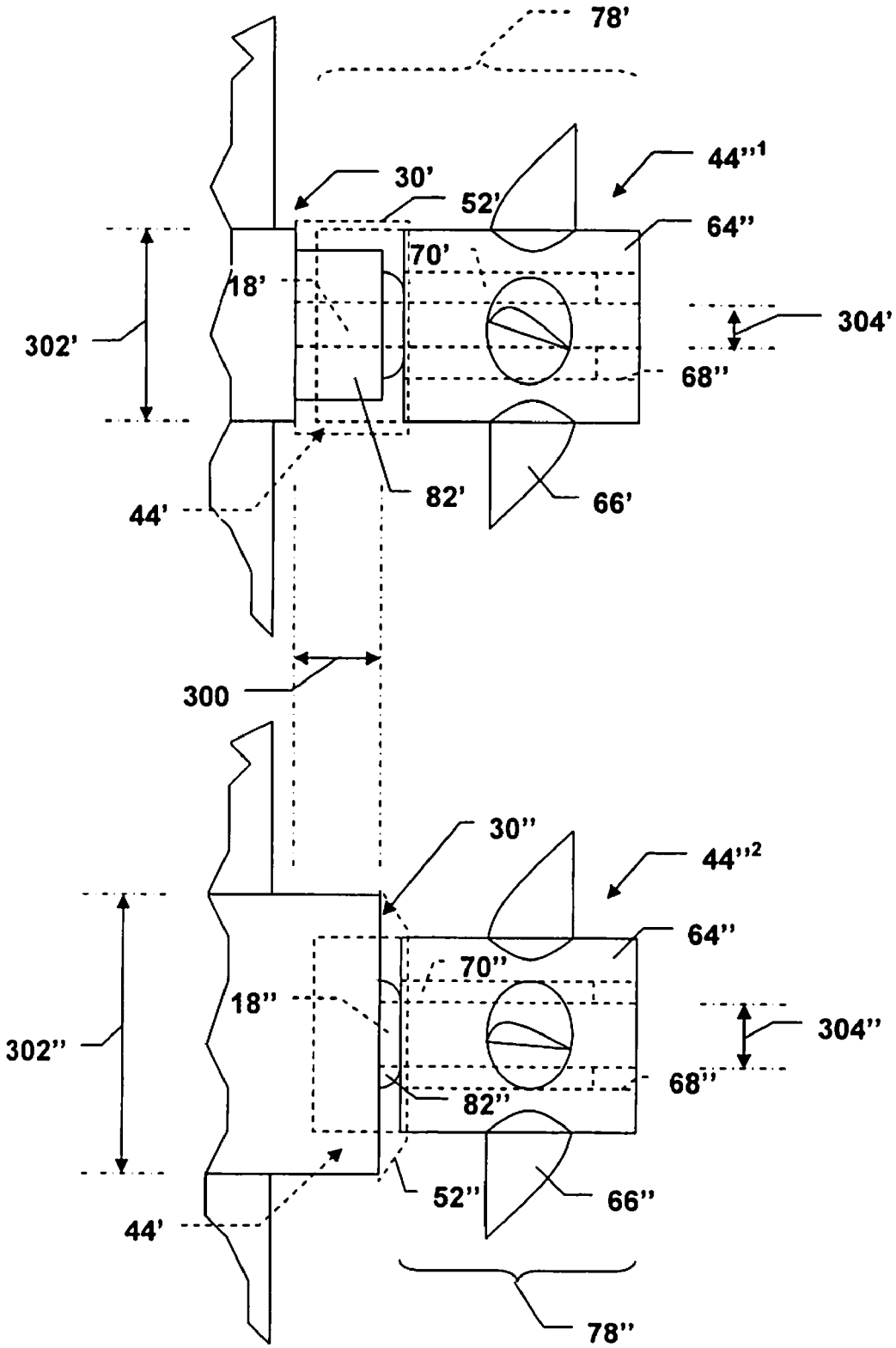
FIG. 6 is a comparative side view of two different pump jet assemblies on different marine drives within a range, according to a further aspect of the present invention.

With reference to FIGS. 5 and 6, it will be explained how the pump jet assembly 40 allows for a method of making a pump jet adapter system for a range of marine drives. At block 200, a variation in parameters is assessed for a range of marine drives, for example, outboard motors. At block 202, rotor parameters are set to allow a rotor and associated components, such as a shroud and stator, to be used universally for all marine drives within the range. At block 204, parameters are set for adapter components corresponding to specific drives within the range. Though not necessarily limited thereto, the present inventors have identified significant parameters that vary between different makes and models of outboard motors, which can be accommodated by a pump jet adapter system.

One variable parameter is the rearward location of the gear housing axial end face (block 206). Gear housing axial end face 30' represents a least rearward location within the range and gear housing axial end face 30" represents a most rearward location within the range. There is a difference 300 between the least and most rearward locations. The present inventors have found that the rearward location of axial end faces of gear housing within a wide range of commercially available marine drives varies by approximately 1.04 inches. For efficiency of illustration, only two marine drive variations are shown in FIG. 6. It will be appreciated that there may be more than two makes or models within the range of marine drives.

A rotor 44' with an axial length of 78' is too long to be utilizable in connection with gear housing axial end face 30", as the desired axial standoff distance, that is, the distance between the axial forward end face of the rotor and the axial end face of the gear housing, would be less than zero. To be universally utilizable with all marine drives in the range, a rotor 44" is dimensioned with an axial length 78", such that the desired axial standoff distance will be greater than zero for all marine drives within the range (block 208).

Axial adapters 82', 82" are dimensioned with varying axial lengths to allow the desired standoff distance to be achieved for each marine drive within the range (block 210). For marine drives requiring longer axial adapters, a substantial axial gap results between the gearing housing end face and the forward axial end face of the rotor, which may disrupt the smooth flow of water onto the rotor 44". Housing adapters are dimensioned with varying axial lengths to allow for the smooth flow of water over such gaps. Housing adapters 52' and 52" are dimensioned with varying axial lengths (block 212) to correspond to the differing axial length of the gaps.

Another variable parameter is the radial dimension of the gear housing (block 214). The diameter 302' of the gear housing 16' is smaller than the diameter 302" of the gear housing 16". To ensure smooth flow from each gear housing 16', 16" onto the rotor 44", the radial dimensions of the forward axial end of the housing adapter 52' are set smaller (block 216) than those of the housing adapter 52" to correspond to the smaller diameter 302'.

A further variable parameter is propeller shaft diameter (block 220). The diameter 304' of the propeller shaft 18' is smaller than the diameter of the propeller shaft 18". Accordingly, the radial dimensions of the sleeve passage 68" of the rotor 44" are set large enough to accommodate either propeller shaft 18', 18" (block 222). The rotor adapter sleeves 70', 70" are differently dimensioned to accommodate the differing radial gaps between the propeller shafts 18', 18" and the sleeve passage 68" (block 224). Additionally, the inner diameter of the axial rotor adapters 82', 82" are differently dimensioned to accommodate the different propeller shaft 18', 18" diameters (block 226).

An additional variable parameter is the horsepower of the marine drive. To allow the rotor 44" to be adaptable for a variety of power outputs (without having to use a plurality of different rotor sizes), the rotor blades can be set a varying fixed pitches. For instance, the blades 66' are set at a lower pitch than the blades 66", allowing the rotor 44" with the blades 66" to deliver accommodate a higher output horsepower (block 232).

It will be appreciated from the foregoing that the present invention advantageously allows the use of universal components, and in particular, a universal rotor, shroud and stator, when retrofitting pump jet assemblies onto marine drives. Accordingly, production times and costs can be significantly lowered due to greater standardization. In addition to lowering the cost of pump jet assemblies for initial retrofits, replacement part costs are also significantly reduced.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and the claims appended hereto.

What is claimed is:

1. A pump jet assembly for a marine drive comprising:

a shroud;

a stator fixedly arranged within the shroud;

a rotor rotatably arranged within the shroud, and having a sleeve passage defined therein extending from a forward to a rear axial end of the rotor;

a rotor adapter sleeve accommodated within the sleeve passage and having a shaft passage defined therein for accommodating a propeller shaft of the marine drive; and an axial rotor adapter concentric with the shaft passage and engaging the forward axial end of the rotor.

2. The assembly of claim 1, further comprising a housing adapter connected to forward stationary vanes of the shroud and connectable about a gear housing axial end face of the marine drive.

3. The assembly of claim 2, wherein the shroud includes a front shroud portion having the forward stationary vanes and a rear shroud portion having the stator.

4. The assembly of claim 1, further comprising a rotor securing adapter connectable about the propeller shaft of the marine drive proximate to the rear axial end of the rotor.

5. The assembly of claim 4, wherein the shaft passage includes an expanded portion within which the rotor securing adapter is accommodated.

* * * * *